US009157234B1

(12) United States Patent
Foster

(10) Patent No.: US 9,157,234 B1
(45) Date of Patent: Oct. 13, 2015

(54) FREE-STANDING FORM FOR BUILDING A PRE-INSULATED WALL

(76) Inventor: James R. Foster, Grahamsville, NY (US)

( * ) Notice: Subject to any disclaimer, the term of this patent is extended or adjusted under 35 U.S.C. 154(b) by 198 days.

(21) Appl. No.: 12/780,101

(22) Filed: May 14, 2010

(51) Int. Cl.
*E04B 2/86* (2006.01)

(52) U.S. Cl.
CPC ..... *E04B 2/8652* (2013.01); *E04B 2002/867* (2013.01)

(58) Field of Classification Search
CPC ..... E04B 2/8657; E04B 2/86; E04B 2/8611; E04B 2/8635; E04B 2/8647; E04B 2/8652; E04B 2002/867; E04B 2002/86
USPC ..... 52/204.1, 414, 241, 431, 427, 428, 32, 52/562, 481.1, 309.9, 309.11, 309.12, 52/309.16, 309.17, 425, 426
See application file for complete search history.

(56) References Cited

U.S. PATENT DOCUMENTS

| | | | | |
|---|---|---|---|---|
| 4,669,234 | A * | 6/1987 | Wilnau | 52/98 |
| 5,311,718 | A | 5/1994 | Trousilek | |
| 5,323,578 | A | 6/1994 | Chagnon et al. | |
| 5,860,262 | A | 1/1999 | Johnson | |
| 6,070,380 | A * | 6/2000 | Meilleur | 52/309.7 |
| 6,178,711 | B1 | 1/2001 | Laird et al. | |
| 6,263,628 | B1 | 7/2001 | Griffin | |
| 6,321,498 | B1 | 11/2001 | Trovato | |
| 6,363,683 | B1 | 4/2002 | Moore | |
| 6,389,758 | B1 * | 5/2002 | Martin, Jr. | 52/125.2 |
| 6,935,081 | B2 * | 8/2005 | Dunn et al. | 52/426 |
| 7,278,244 | B1 * | 10/2007 | Rubio | 52/600 |
| 2003/0056462 | A1 * | 3/2003 | Roy, Sr. | 52/741.13 |
| 2004/0016194 | A1 * | 1/2004 | Stefanutti et al. | 52/425 |
| 2008/0271401 | A1 * | 11/2008 | Grypeos | 52/426 |
| 2009/0205277 | A1 * | 8/2009 | Gibson | 52/309.9 |
| 2010/0083595 | A1 * | 4/2010 | Rizzotto, Sr. | 52/204.1 |

* cited by examiner

*Primary Examiner* — Elizabeth A Plummer
*Assistant Examiner* — Kyle Walraed-Sullivan
(74) *Attorney, Agent, or Firm* — Mark Levy; Hinman, Howard & Kattell, LLP

(57) ABSTRACT

A free-standing, hollow, prefabricated concrete form for forming a lost form, pre-finished concrete wall having an insulating layer on at least one major surface, typically an outer, earth facing surface thereof. The inside of the form has a rough finished surface. The form provides metal studs, typically on conventional sixteen inch centers, thereby enhancing the strength of the wall. The form allows placement of conduits for wiring, either electrical power or so-called low voltage circuits (e.g., telephone, TV cable, network wiring, audio cables, etc.) within the wall. Water supply and drain lines may also be placed within the wall prior to filling the forms with concrete. Multiple prefabricated sections may be joined to one another end-to-end to fabricate longer walls.

14 Claims, 8 Drawing Sheets

FREE-STANDING FORM FOR BUILDING A PRE-INSULATED WALL

BACKGROUND OF THE INVENTION

1. Field of the Invention

The invention pertains to modular forms for forming free standing, concrete-filled walls and, more particularly, to modular, pre-insulated forms readily assembled and adapted to receive concrete therein.

The process of forming vertical walls from poured concrete has been known for centuries. The process, while theoretically simple, typically requires highly skilled laborers and expensive forms to accomplish. Forms may be either built for single use or may be formed from modular sections assembled to the required configuration. Upon curing of the concrete wall poured therein, the reusable forms are typically removed and stored for later use on another project.

Insulated concrete walls are sometimes constructed using form assemblies having insulation disposed as a part of the form. The form becomes part of the concrete wall. This type of construction is typically referred to as lost form construction.

Regardless of the type of form utilized to construct a poured concrete wall, two major problems remain. First, the construction or assembly of forms typically requires skilled labor and is time intensive. In addition, a large capital expense is typically required in obtaining reusable forms. There is further expense involved in removing forms from storage, transporting forms to a job site, removing forms once a concrete wall has sufficiently cured, and finally, shipping the forms back to storage. When forms are not properly constructed or set, finished walls may be out of square or plumb, be of the wrong dimension, and/or have bulges or other abnormalities. It is not uncommon have to destroy one or more of the poured walls, reset the forms, and re-pour the concrete. This results in further expense as well as delays in the construction project.

The second problem is that poured concrete walls constructed using forms of the prior art are notoriously difficult to finish.

2. Discussion of the Related Art

Several attempts to provide lost form type forms for building concrete filled walls appear in the prior art. For example, U.S. Pat. No. 5,311,718 for FORM FOR USE IN FABRICATING WALL STRUCTURES AND A WALL STRUCTURE FABRICATION SYSTEM EMPLOYING SAID FORM, issued May 17, 1994 to Jan P. V. Trousilek teaches a modular form system utilizing prefabricated plastic forms.

U.S. Pat. No. 5,323,578 for PREFABRICATED FORMWORK issued Jun. 28, 1994 to Claude Chagnon et al. shows a prefabricated, collapsible formwork having flexible connecting elements.

U.S. Pat. No. 5,860,262 for PERMANENT PANELIZED MOLD APPARATUS AND METHOD FOR CASTING MONOLITHIC CONCRETE STRUCTURES IN SITU, issued Jan. 19, 1999 to Frank. K. Johnson provides a system of interlocking form sections for forming continuous concrete walls, the form sections becoming a permanent part of the finished wall.

U.S. Pat. No. 6,178,711 for COMPACTLY-SHIPPED SITE-ASSEMBLED CONCRETE FORMS FOR PRODUCING VARIABLE-WIDTH INSULATED-SIDEWALL FASTENER-RECEIVING BUILDING WALLS, issued Jan. 30, 2001 to Andrew Laird et al., teaches yet another system for assembling forms on site to fabricate a lost form concrete wall having a cavity into which reinforcing steel, electrical and/or communications conduits, plumbing, etc. may be placed prior to filling the form with concrete.

U.S. Pat. No. 6,263,628 for LOAD BEARING BUILDING COMPONENT AND WALL ASSEMBLY METHOD, issued Jul. 24, 2001 to John Griffin teaches another lost form system wherein regularly spaced apart studs help define a cavity into which concrete is poured.

U.S. Pat. No. 6,321,498 for FORMWORK FOR BUILDING WALLS, issued Nov. 27, 2001 to Salvatore Trovato teaches another modular form system for creating a lost form, concrete filled, insulated wall.

U.S. Pat. No. 6,363,683 for INSULATED CONCRETE FORM, issued Apr. 2, 2002 to James Daniel Moore, Jr. shows yet another modular form system for fabricating lost form, concrete filled, insulated walls.

None of the patents and published patent applications, taken singly, or in any combination are seen to teach or suggest the novel free-standing form system for fabricating an insulated, concrete filled wall of the present invention.

SUMMARY OF THE INVENTION

In accordance with the present invention there is provided a prefabricated concrete form for forming a lost form, pre-finished concrete wall. An insulating layer is preformed on an outside (i.e., earth facing) side of the form. The inside of the form has a rough finished surface that is treatable with any typical decorative finish commonly used in the industry with regard to interior wall finishing. The form provides metal studs, typically on conventional sixteen inch centers, thereby allowing treatment of the resulting concrete wall in a manner similar to a wood framed wall.

The novel system allows placement of conduits for wiring either electrical power or so-called low voltage circuits (e.g., telephone, TV cable, network wiring, audio cables, etc.) within the wall. Water supply and drain lines may also be placed within the wall prior to filling the forms with concrete.

It is, therefore, an object of the invention to provide a modular, free-standing lost form concrete form for creating a concrete-filled, free standing wall.

It is another object of the invention to provide a modular, free-standing lost form concrete form that may readily be interconnected to form long, continuous wall sections.

It is an additional object of the invention to provide a modular, free-standing lost form concrete form wherein conduits for electrical circuits and/or water supply and drain lines may be preinstalled within the form prior to filling the form with concrete.

It is a further object of the invention to provide a modular, free-standing lost form concrete form having insulating board pre-placed on the outside of the form.

It is a still further object of the invention to provide a modular, free-standing lost form concrete form having a magnesium oxide insulating board pre-placed on the outside of the form.

It is another object of the invention to provide modular, free-standing lost form concrete form into which an opening to accommodate a door, window, or other portal may readily be placed.

It is yet another object of the invention to provide a modular, free-standing lost form concrete form that has metal studs on a standard center-to-center spacing, for example, 16 inch centers, pre-placed within the form.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a modular, free-standing form system for forming concrete filled walls having a pre-insulated outer surface and a roughly finished inner surface. The forms are of the lost form variety wherein the form becomes a permanent part of the concrete filled wall.

Figure 1:
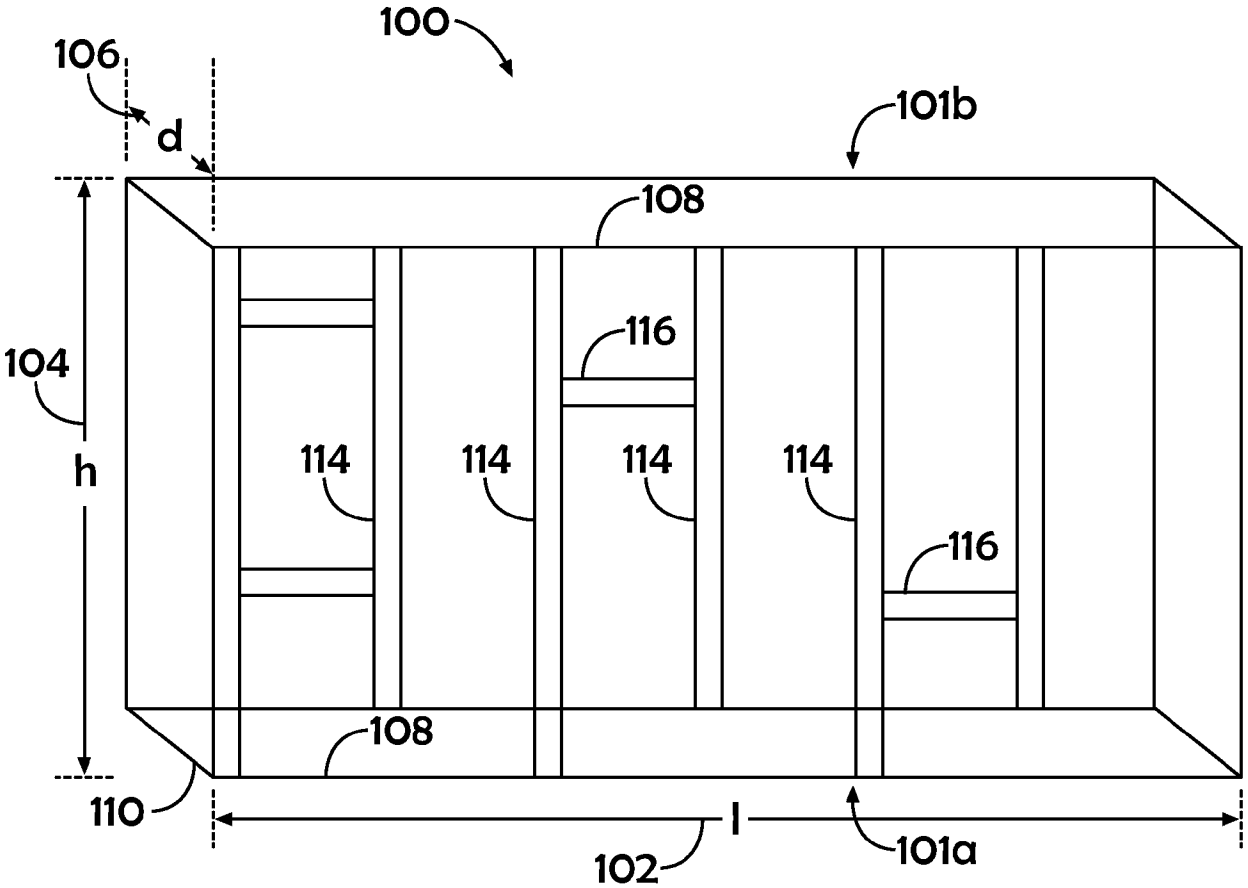
FIG. 1 is a front, perspective, schematic view of a section of the free-standing form in accordance with the invention.

Referring first to FIG. 1, there is shown a front, perspective, schematic view of a section of the free-standing form in accordance with the invention, generally at reference number 100. Free-standing form 100 has a length "l" 102, a height "h" 104, and a depth "d" 106. In the embodiment chosen for purposes of disclosure, length "l" 102 is approximately 24 feet (7.3 m), height "h" 104 is approximately 10 feet (3 m), and depth "d" 106 is in the range of approximately 8-12 (0.2-0.3 m) inches. It will be recognized that free-standing form 100 may be implemented in many other sizes and, consequently, the invention is not considered limited to the dimensions chosen for purposes of disclosure. Rather, the invention covers free-standing forms in all practical dimensions.

Free-standing form 100 has a rectangular base 101*a* formed from angle stock, typically treated steel angle stock or the equivalent. Long angle stock members 108 are joined to short angle stock members 110 at intersections thereof using self tapping screws 112, not shown in FIG. 1 and best seen in FIGS. 2*a* and 2*b*. While self tapping screws 112 have been chosen for purposes of disclosure, it will be recognized by those of skill in the art that other suitable fasteners or joining methods may be substituted therefor. In addition to fasteners, adhesives or spot welding may be used to join long angle stock members 108 to short angle stock members 110.

Top frame 101*b*, substantially identical to the base 101*a* is formed from long angle sections 108 and short angle sections 110, also held together by self tapping screws 112 or the like.

Studs 114 are placed at predetermined intervals along both front and back long angle stock members 108 and are also attached to base 101*a* and top frame 101*b* by self tapping screws 112 or the like. Studs 114 are metal "C" studs well known to those of skill in the art and not further described herein. Studs 114 are typically placed at regular intervals on industry standard center-to-center spacing, for example 16 or 24 inch spacing behind stud material.

The depth dimension "d" 106 is established by spacers 116 that tie studs 114 located at the front of free-standing form 100 corresponding studs 114 at the rear thereof. Spacers 116 are short lengths of "C" stud material identical to the material from which studs 114 are fabricated.

Figure 2A:
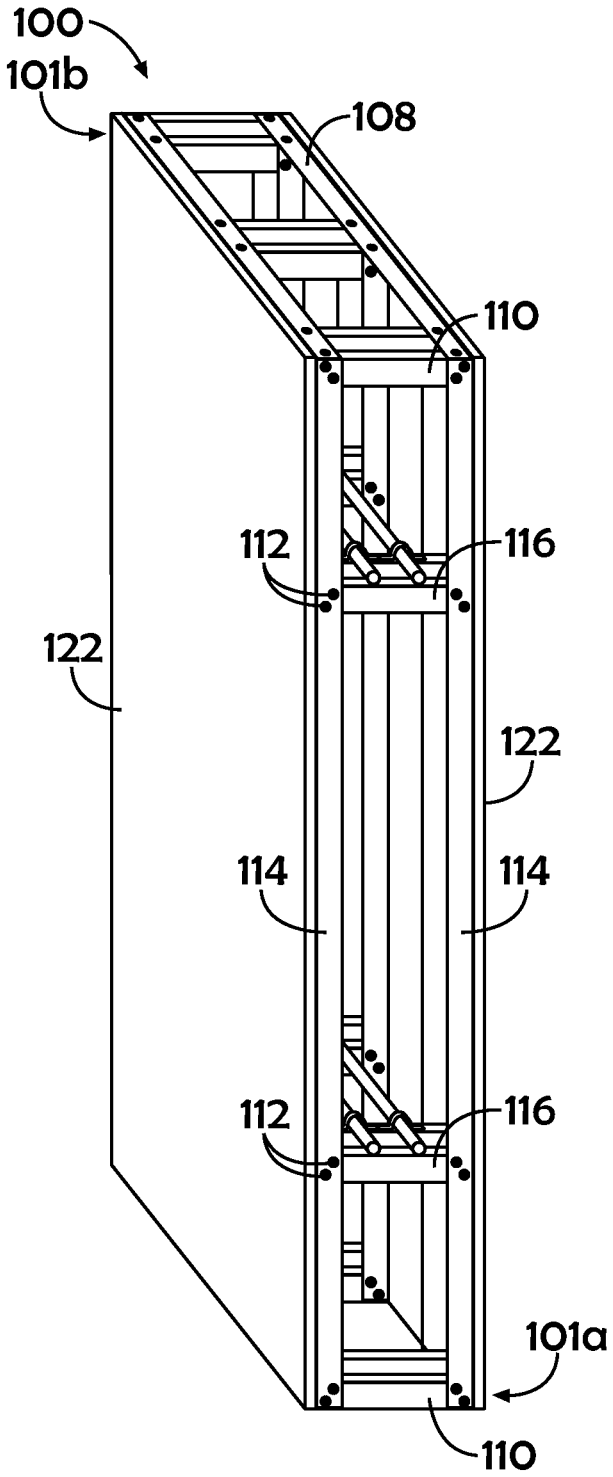
FIG. 2*a* is an end, perspective, schematic view of the free-standing form of FIG. 1.
Figure 2B:
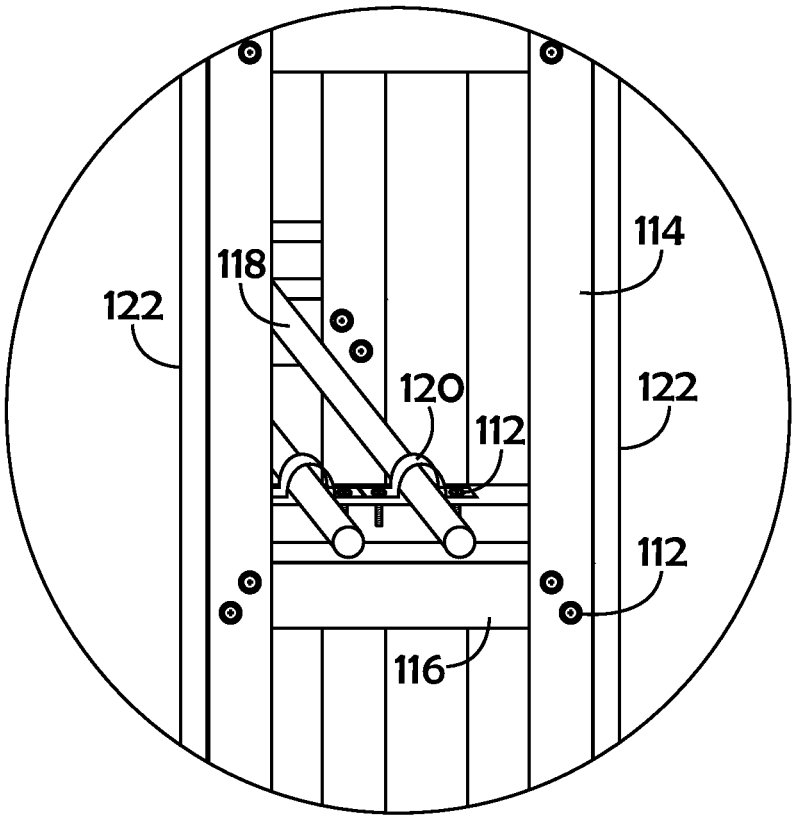
FIG. 2*b* is a detailed portion of the view of FIG. 2*a;*

Referring now also to FIGS. 2*a* and 2*b*, there are shown an end, perspective, schematic view of the free-standing form 100 and a detailed portion of the view of FIG. 2*a*, respectively. Spacers 116 may readily be seen in FIGS. 2*a* and 2*b*.

A reinforcing steel bar, known as rebar 118, is loosely secured to a top surface of spacer 116 by clamps 120. Rebar is well known to those of skill in the art and is not further discussed herein. Further, rebar 118 forms no part of the present invention and is shown only to illustrate the intended use environment of free-standing form 100.

Clamps 120 are typically straps such as one hole conduit straps well known to those of skill in the art. Clamps 120 are typically attached to the upper surface of spacers 116 by a single self tapping screw 112. It will be recognized that many alternate clamps or fastening methods may be substituted for clamps 120 for securing rebar 118 to spacers 116.

A sheet of insulating board 122 is shown attached to outer faces, not specifically identified, of studs 114 of both major surfaces of free-standing form 100. In the embodiment chosen for purposes of disclosure, insulating board 122 is 12 mm (approximately 0.5 inch) thick magnesium oxide board such as Magnum® board provided by MBP Magnum Building Products of Tampa, Fla. USA. Magnesium oxide (MgO) board is chosen for its many desirable properties for below grade installation. MgO board is waterproof, mold and bacteria resistant, dimensionally stable, and is structurally durable. The insulating board 122 is attached to the MgO board. The MgO board is a minimum of 0.5 inch thick. While the MgO board has some insulating value, it is only R 1.2. The MgO board is fire rated, non-carcinogenic, insect proof (i.e., termites, carpenter ants), and silica free.

Figure 3:
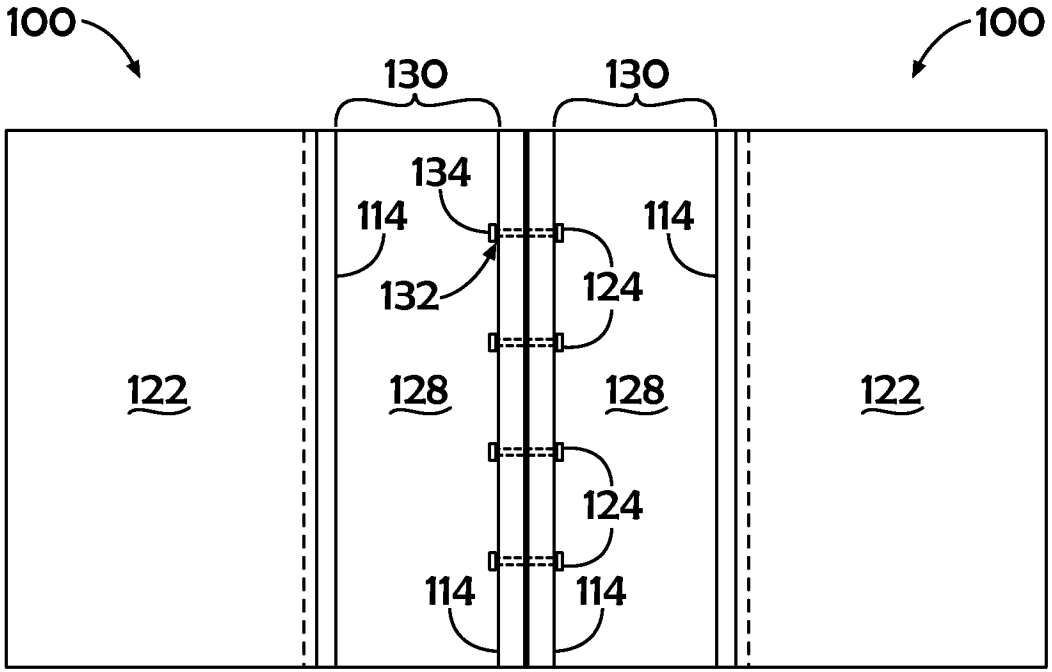
FIG. 3 is a side, elevational, schematic view of two sections of the free-standing form of FIG. 1 joined together end-to-end.

Referring now to FIG. 3, there is shown a front, elevational, schematic view of a pair of free-standing forms 100 joined end-to-end to one another. When insulating board 122 is placed on a major surface of a free-standing form 100, a gap 130 may be left to allow access to an interior region 128 within free-standing form 100. Gap 130 allows access to end studs 114 so that two sections of free-standing form 100 may be joined end-to-end to one another. The gap is closed after joining forms.

Joining bolts 124 with washers 132 and nuts 134 may be used to abut end studs 114 of adjoining sections. It will be recognized by those of skill in the art that other devices and/or techniques may be used to join sections of free-standing form 100 to one another. Such devices and/or techniques are believed to be known and are not further discussed herein. The invention includes any and all such devices and/or techniques and is, therefore, not considered limited to joining bolts 124, washers 132, and nuts 134 chosen for purposes of disclosure.

Figure 4:
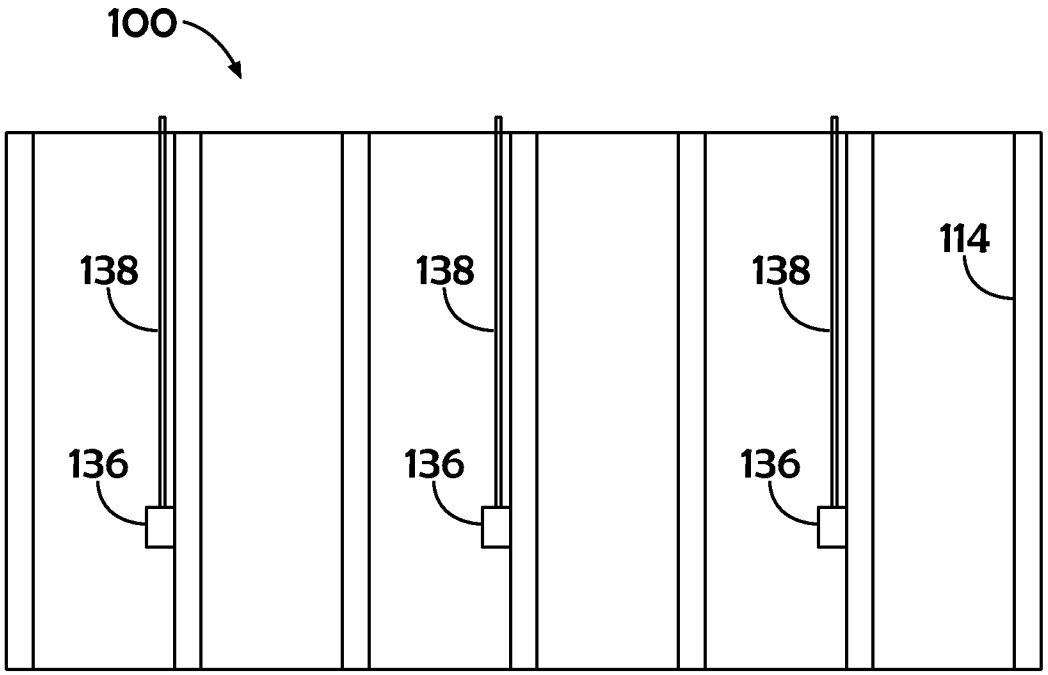
FIG. 4 is a side, elevational, schematic view of the free-standing form of FIG. 1 showing electrical wiring boxes and conduits in place.

Referring now also to FIG. 4, there is shown a front, elevational, schematic view of free-standing form 100 having electrical boxes 136 embedded therein. Electrical boxes 136 are connected to conduits 138 that are placed within free-standing form 100 to allow in-the-wall wiring in the final concrete-filled wall section made from free-standing form 100. While individual conduits 138, each connected to a single box 136 are shown, it will be recognized that alternate wiring arrangements may be placed inside free-standing form 100 prior to the filling thereof with concrete. Boxes 136 are schematic and are intended to represent any electrical box whether for power or low voltage/communications applications.

Figure 5:
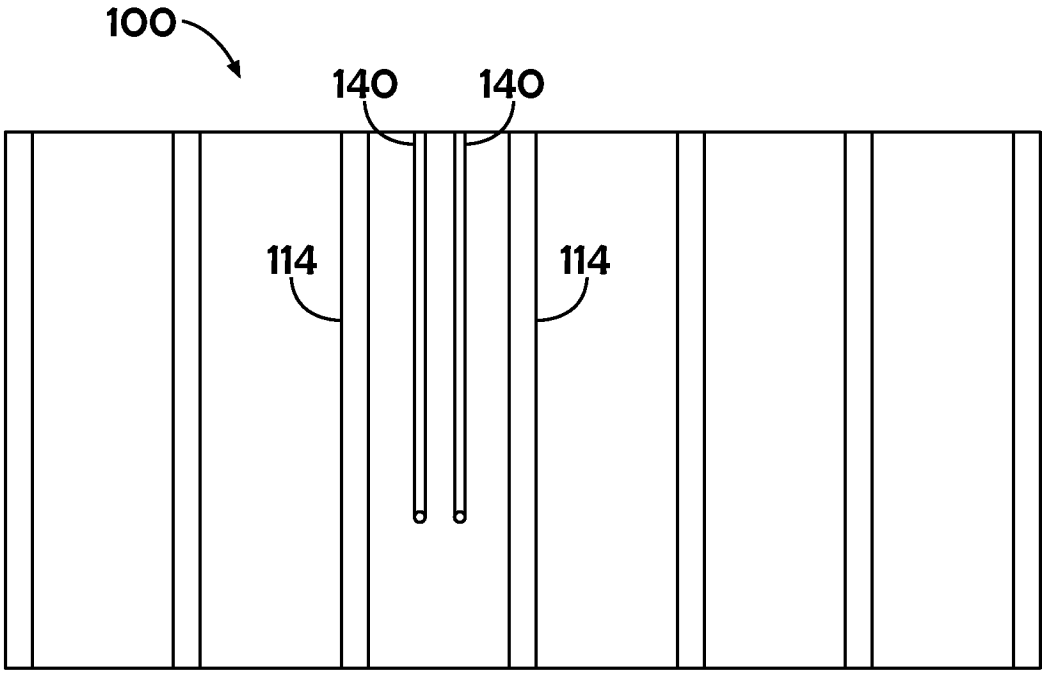
FIG. 5 is a side, elevational, schematic view of the free-standing form of FIG. 1 showing embedded water supply lines.

Referring now also to FIG. 5, there is shown a front, elevational, schematic view of a free-standing form 100 having liquid (e.g., water) supply lines 140 or similar plumbing embedded therein. Like conduits 138 (FIG. 4), that are placed within free-standing form 100, water supply lines 140 are routed to the top of free-standing form 100 for connection to hot and cold water supplies, not shown, or the like. It will be recognized that FIG. 5 is schematic and that water supply lines 140 may represent any in-the-wall plumbing such as a compressed air line, an oxygen line, a vacuum line, or any other supply or suction line.

Figure 6:
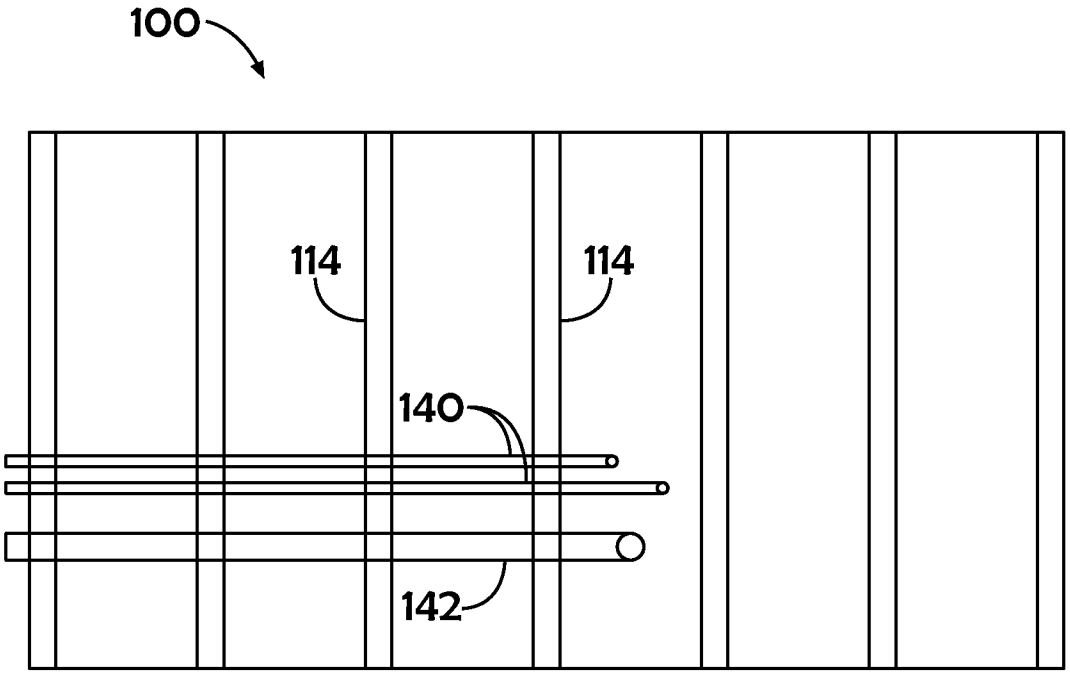
FIG. 6 is a side, elevational, schematic view of the free-standing form of FIG. 1 showing an alternate embodiment having water supply and drain lines embedded in the free-standing form of FIG. 1.

Referring now also to FIG. 6, there is shown a front, elevational, schematic view of a free-standing form 100 having both water supply lines 140 or similar plumbing, as well as a drain connection 142 embedded therein. In this embodiment, both water supply lines 140 and drain connection 142 are run horizontally across an interior region of free-standing form 100. It will be recognized that drain line 142 is preferably installed with an appropriate slope. Both supply lines 140 and drain connection 142 may be connected to mating water supply lines 140 and/or drain line 142 at the interface between adjacent sections of free-standing forms 100.

Figure 7:
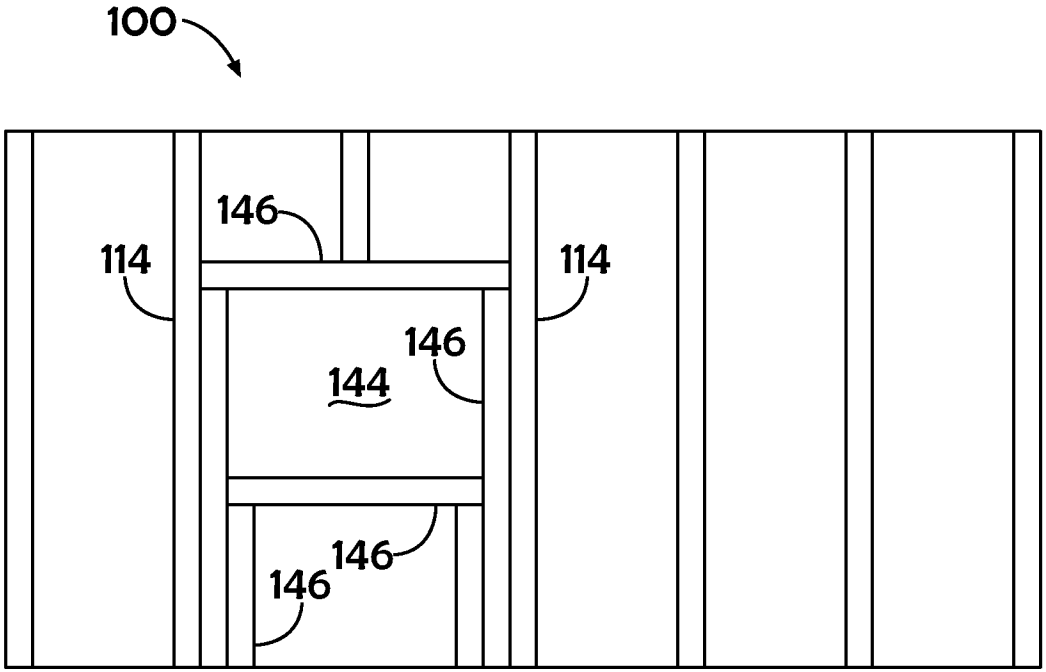
FIG. 7 is a side, elevational, schematic view of the free-standing form of FIG. 1 showing framing modified to accommodate a window therein.

Referring now also to FIG. 7, there is shown a front, elevational, schematic view of a free-standing form 100 having an opening 144 in the framing to allow installation of a window, not shown. Framing elements, possibly formed from the same material as studs 114 discussed hereinabove, are used to define opening 144 into which a pre-hung window or the like can be placed upon completion of the concrete filled wall defined by free-standing form 100. It will be noted that any opening formed through free-standing form 100 must be sealed from front to back to seal the concrete pour, not shown, within free-standing form 100. While an opening 144 for a window has been chosen for purposes of disclosure, it will be recognized that openings suitable for doors or other portals may likewise be placed in free-standing form 100. Consequently, the invention is not considered limited to openings for windows but rather includes any opening through the wall formed by filling free-standing form 100 with concrete.

In use, one or more free-standing forms 100 are fabricated as described hereinabove. If two or more free-standing forms 100 are required to form the length of wall desired, adjacent forms must be secured to one another end-to-end. Any plumbing or electrical components that must connect at the edges of free-standing form 100 sections must be made.

Rebar must be inserted and secured within free-standing forms(s) 100. For safety and aesthetics, exposed ends of free-standing form(s) 100 should be covered. Typically, the horizontal rebar is already installed in the walls. It is necessary to join the pre-installed rebar only where the wall sections come together.

Finally, once free-standing form(s) 100 are fully prepared and braced as required, concrete, not shown, may be poured into the hollow, interior spaces 128 within free-standing forms 100. Once the concrete is cured, the resulting wall may be backfilled using backfilling materials and techniques well known to those of skill in the art. Interior finishing may be accomplished utilizing studs 114 or the insulating board 122 forming the interior surface of the wall.

When required, electrical circuits and/or plumbing may be completed using conduits 138 and/or water supply and drain lines 140, 142, respectively. Interior finishing of MgO walls is accomplished utilizing conventional materials and methods. All that is required prior to final finishing is taping and spackling the few joints where the wall sections join.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A free-standing, hollow form for a lost form, concrete-filled wall, comprising:

a) a bottom and a top framework each having a length and a width, said length being greater than said width and defining a major axis therealong, said width being perpendicular to said major axis and defining a minor axis therealong, elements of said top framework and said bottom framework comprising two parallel, spaced-apart long pieces of angle stock defining said length connected to shorter pieces of angle stock defining said width, said long pieces of said angle stock and said shorter pieces of angle stock being disposed normally to one another;

b) a plurality of studs having a predetermined length and being disposed between and attached to said bottom framework and to said top framework, said plurality of studs being disposed in a perpendicular relationship to said major axis of each of said top framework and said bottom framework, said studs being disposed along both a front edge and a rear edge of both of said bottom framework and said top framework, said studs being spaced apart from one another by a predetermined distance;

c) a plurality of spacers having uniform, planar upper and lower surfaces and a predetermined length and being disposed between said studs, each of said plurality of spacers being disposed at any one of an infinite number of positions along the length t of said studs, said spacers being disposed along said front edge of both said top framework and said bottom framework and a corresponding stud placed along an opposite one of said front edge and said rear edge of both said top framework and said bottom framework, said plurality of spacers each being parallel to said minor axis;

d) at least one reinforcing bar connected to each of said plurality of front edge spacers, each of said plurality front edge spacers being disposed at any at any one of an infinite number of positions along said length of said studs and extending perpendicular to said front edge spacers and connected to each of said corresponding plurality of rear edge spacers, respectively, for providing stability and reinforcement of said hollow form; and e) a planar material attached to a front face and a rear face of said free-standing hollow form, said front face and said rear face thereof each being defined by respective outfacing surfaces of said plurality of studs, a major plane of said planar material being parallel to said major axis.

2. The free-standing, hollow form for a lost form, concrete-filled wall as recited in claim 1, wherein said top framework and said bottom framework comprise elements formed from metal, angle stock or track.

3. The free-standing, hollow form for a lost form, concrete-filled wall as recited in claim 1, wherein said long pieces of said angle stock are connected to said shorter pieces of said angle stock by fasteners comprising self tapping screws.

4. The free-standing, hollow form for a lost form, concrete-filled wall as recited in claim 1, wherein each of said plurality of studs comprises a metallic stud having at least three sides disposed normally to an adjacent side.

5. The free-standing, hollow form for a lost form, concrete-filled wall as recited in claim 4, wherein each of said plurality of studs is affixed to both said top framework and said bottom framework using at least one fastener comprising a self tapping screw.

6. The free-standing, hollow form for a lost form, concrete-filled wall as recited in claim 1, wherein each of said plurality of studs is spaced apart along a respective front edge and a back edge of each of said top framework and said bottom framework at a predetermined distance.

7. The free-standing, hollow form for a lost form, concrete-filled wall as recited in claim 6, wherein said predetermined distance comprises a distance selected from the group: approximately 16 inches (0.4 m) and approximately 24 inches (0.6 m).

8. The free-standing, hollow form for a lost form, concrete-filled wall as recited in claim 1, further comprising:

f) a planar material attached to at least one end of said free-standing hollow form, said planar material being attached to an outfacing side surface of one of said plurality of studs at both a front edge and a respective back edge of said free-standing hollow form, said planar material being parallel to said minor axis.

9. The free-standing, hollow form for a lost form, concrete-filled wall as recited in claim 8, wherein at least a respective one of said thin, planar material attached to said front face, said rear face and said end of said free-standing, hollow form comprises an insulating material.

10. The free-standing, hollow form for a lost form, concrete-filled wall as recited in claim 8, wherein at least a respective one of said thin, planar material attached to said front face, said rear face and said end of said free-standing, hollow form comprises a magnesium oxide board having a predetermined thickness.

11. The free-standing, hollow form for a lost form, concrete-filled wall as recited in claim 10, wherein said magnesium oxide board predetermined thickness is at least approximately 0.5 inch (0.013 m).

12. The free-standing, hollow form for a lost form, concrete-filled wall as recited in claim 8, further comprising:

g) at least one article selected from the group: an electrical box, an electrical conduit, a supply pipe, and a drain line disposed within said free-standing, hollow form.

13. The free-standing, hollow form for a lost form, concrete-filled wall as recited in claim 8, further comprising:

g) an opening in said front face and said rear face to accommodate at least one article selected from the group: a window, a door, and another opening.

14. The free-standing, hollow form for a lost form, concrete-filled wall as recited in claim 13, wherein said opening comprises framing elements disposed therearound.

* * * * *